United States Patent [19]

Aupoix et al.

[11] 3,952,407

[45] Apr. 27, 1976

[54] METHOD FOR THE MANUFACTURE OF WAVEGUIDE

[75] Inventors: Marcel Aupoix, Paris; Jean-Pierre Trezeguet, Venissieux, both of France

[73] Assignee: Les Cables de Lyon, Lyon Cedex, France

[22] Filed: Apr. 18, 1975

[21] Appl. No.: 569,428

[30] Foreign Application Priority Data

Apr. 25, 1974 France ..... 74.14461

[52] U.S. Cl. ..... 29/600; 264/83; 264/173; 425/114; 425/324 R; 425/518; 425/DIG. 200; 425/DIG. 201

[51] Int. Cl.[2] ..... H01P 11/00; H01Q 13/00

[58] Field of Search ..... 29/600, 163.5 CW; 264/83, 173; 57/9; 72/47, 136; 333/95, 96, 97, 98; 425/500, 518, 114, 324 R, DIG. 200, DIG. 201

[56] References Cited

UNITED STATES PATENTS

| | | | |
|---|---|---|---|
| 3,271,064 | 9/1966 | Hall | 425/500 X |
| 3,470,051 | 9/1969 | Meyer | 425/500 X |
| 3,769,697 | 11/1973 | Priaroggia et al. | 29/600 |
| 3,779,846 | 12/1973 | Kleykamp | 72/135 X |

FOREIGN PATENTS OR APPLICATIONS

| | | | |
|---|---|---|---|
| 887,063 | 1/1962 | United Kingdom | 333/98 |

*Primary Examiner*—Victor A. DiPalma
*Attorney, Agent, or Firm*—Sughrue, Rothwell, Mion, Zinn & Macpeak

[57] ABSTRACT

The invention concerns electromagnetic wave guides. It has as its object a wave guide comprising a hollow conductor consisting of layers of porous dielectric or conductive materials, bound together and to the hollow conductor by a resinous compound, at ambient temperature, in a very short time, in contact with a gaseous catalyst. It is applied, to great advantage, to the continuous manufacturing of wave guides.

4 Claims, 1 Drawing Figure

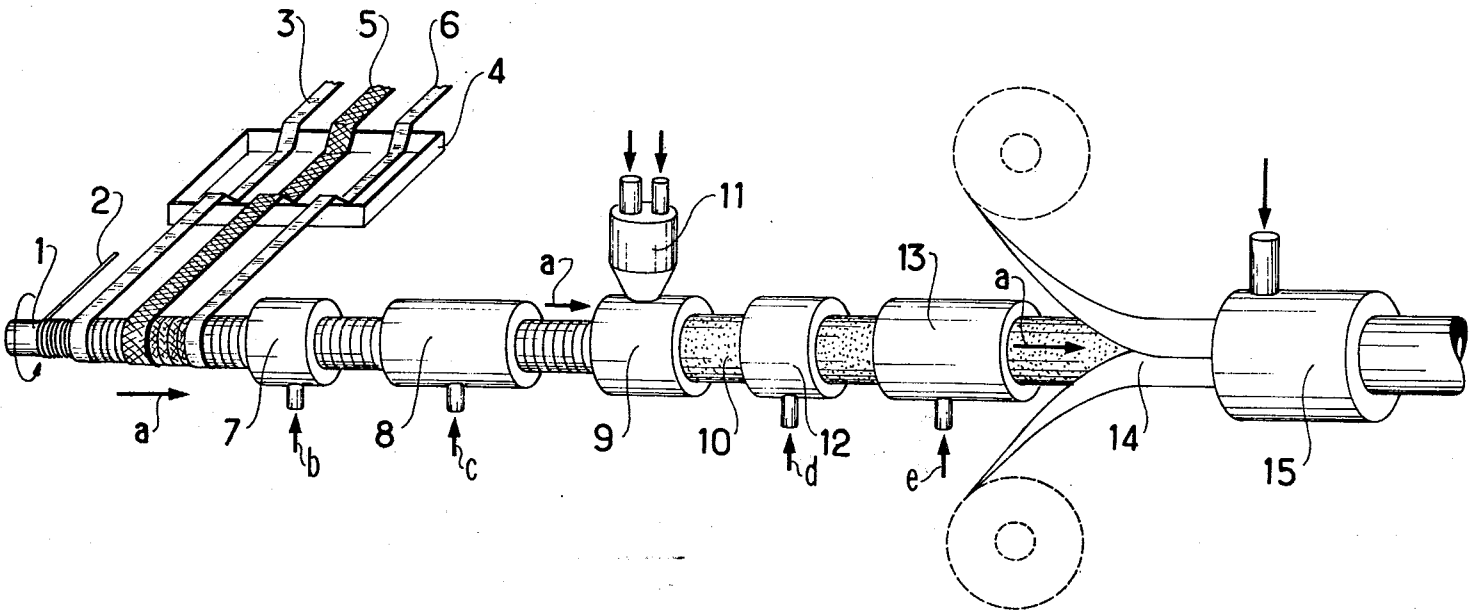
1
2
3
4
5
6
a
7
b
8
c
9
a
10
11
12
d
13
e
a
14
15

METHOD FOR THE MANUFACTURE OF WAVEGUIDE

BACKGROUND OF THE INVENTION

1. Field of the Invention

The invention concerns electromagnetic wave guides comprising a hollow conductor externally covered with a casing.

2. Description of the Prior Art

Generally the casing is formed by surrounding the hollow conductor of the wave guide with successive layers of dielectric materials, for example fibre glass or conductive taping, for example taping with woven copper gauze or steel strips. These successive layers are bound together and to the hollow conductor by a resin which is polymerisable when hot.

The hollow conductor is fragile and easily deformable, for it is generally made either with a metallic wire wound in a spiral or with a thin metallic tape folded in the form of a tube. Despite all the care taken in manufacturing the wave guide, it is impossible to prevent the hollow conductor from undergoing deformation during the heat treatment necessary for hardening the resin. These deformations are very detrimental to the quality of the transmission of the electromagnetic waves.

SUMMARY OF THE INVENTION

The aim of the present invention is to prevent these deformations.

It has as its object a wave guide comprising a hollow conductor covered externally by a casing comprising successive layers of dielectric or conductive materials connected together and to the hollow conductor by a resinous compound which hardens at ambient temperature and in a very short time (a few seconds) in contact with a catalyst diluted in a gas, such as a mixture of phenolic resin with an isocyanate.

It also has as its object a method for manufacturing such a wave guide consisting in forming the hollow conductor of the wave guide, applying on the outside of the latter the layers of porous dielectric or conductive materials constituting the casing, the said materials being previously impregnated with a mixture of phenolic resin with an isocyanate and causing the hardening of the mixture by spraying a catalyst such as an amine drawn along by a gas current.

BRIEF DESCRIPTION OF THE DRAWING

Other characteristics and advantages of the invention will become apparent from the following description of a wave guide as well as from that of the method for the manufacturing thereof, both given by way of an example. That description will be given with reference to the single FIGURE of the drawing which illustrates a continuous manufacturing process for a wave guide.

DESCRIPTION OF THE PREFERRED EMBODIMENT

That continuous manufacturing process is carried out by means of a machine of a known type, for example that described in French patent No. 1,604,891, filed in the applicant's name. With such a machine, the wave guide is manufactured continuously. A metal wire 2 is firstly wound round a mandrel 1 which rotates but is linearly stationary. It forms, on the mandrel 1, a conductive winding having contiguous turns which slide in the direction of the free end of the mandrel (direction of the arrow a) by means of an extracting wire guide, (not shown). On that conductive winding are then wound successively a fibre glass tape 3, a woven copper gauze tape 5 and another tape 6 made of fibre glass. For a more detailed explanation of the operation of the machine, the previously cited French patent should be referred to.

The fibre glass tapes 3 and 6 as well as the woven copper gauze tape 5 are, previous to their winding on, impregnated with a mixture of phenolic resin with an isocyanate. That impregnation has been shown by an immerion of the tapes 3, 5 and 6, before winding on, in a tank 4 filled with the said mixture. The tapes 3, 5 and 6 pass, on leaving the tank 4, between wringing rollers, (not shown), which enable the weight of the mixture to be dosed so that the tapes remain porous after impregnation. That pre-impregnation of the tapes 3, 5 and 6 can evidently be effected in many other ways.

The assembly consisting of the winding with contiguous turns and the windings which cover it remain malleable. As manufacturing progresses, it slides along the mandrel 1 and enters a reaction chamber 7 into which is injected, under pressure, an amine drawn along by a current of gas, indicated by the arrow *b*, such as carbon dioxyde. That amine comes into contact, due to the porosity of the different layers, with the mixture of phenolic resin and of isocyanate which hardens and agglomerates the various components of the wave guides. At the outlet of the reaction chamber 7, the wave guide enters a degassing chamber 8 in which a current of compressed air, indicated by arrow *c* draws away the excess amine.

The mixtures of phenolic resins with isocyanates are well known in founding for effecting cold hardened sand casting. For more detailed explanations concerning these mixtures, as well as the choice of the catalyst, that technique should be referred to.

To obtain good production quality, it is preferable to use tapes which are chemically neutral with respect to the isocure resin and to the amine. It is recommended, before winding tape on, to de-enzymate, wash and dry in an oven the fibre glass tapes 3 and 6, to de-grease, wash and dry in an oven the woven copper tape 5 and to store and dry in a stove or in a vacuum the various tapes.

It is quite evident that various modifications may be made to the structure which has just been described. The forming of the hollow conductor can be different. This latter, instead of being a wire wound in a spiral, can be a thin metallic tape folded in the form of a tube. The number and the constitution of the tapes wound round the hollow conductor can be variable.

At the outlet of the degassing chamber 8, the wave guide passes into an extrusion machine 9 where it is covered with a strip 10 of granular material whose grains are neutral, anhydrous and not porous, for example sand or very fine powdered glass, which has previously been mixed in a mulling machine 11 with a phenolic resin and an isocyanate. The percentage of resin being determined as a function of the thickness of the strip and of the granulometry of the material so as to enable proper hardening while maintaining a certain porosity.

At the outlet of the extrusion machine, a fibre glass tape, also impregnated with a mixture of phenolic resin with an isocyanate can be provided on the outside of the strip 10 so as to consolidate the outside surface of the strip 10. That operation is not shown in the FIG-

URE.

The wave guide covered with the strip 10 then passes into a second reaction chamber 12 in which is injected under pressure an amine drawn along by carbon dioxyde, as indicated by arrow *d* coming into contact with the mixture of phenolic resin with an isocyanate covering the granular material which hardens, agglomerating the said granular material.

At the outlet of the reaction chamber 12, the wave guide crosses through a degassing chamber 13 where its shell of granular material is rid of excess amine by a flow of compressed air, as indicated by arrow *e*. It is lastly covered, by a known technique, with a steel strip 14 wound longitudinally with an overlapping configuration and covered by means of a roving and extrusion machine 15 with a PVC casing having a thickness of a few millimeters ensuring the water-proofing of the wave guide and protecting it against corrosion.

The wave guide which is obtained by that continuous manufacturing at ambient temperature has a very great quality and great dimensional stability, since it has neither repairs nor deformations due to heat treatment.

We claim:

1. A method for manufacturing a wave guide comprising the steps of:

forming a hollow conductor;

arranging, round the hollow conductor, layers of porous dielectric or conductive materials previously impregnated with a mixture of phenolic resin with an isocyanate;

spraying on said layers to cause the hardening of the isocure resin an amine carried by a gas current; and removing any excess amine.

2. The method for manufacturing a wave guide comprising the steps of:

forming a hollow conductor;

winding, round the said hollow conductor first layers of dielectric or conductive tape previously impregnated with a mixture of a phenolic resin with an isocyanate;

spraying a gas carrying an amine carried by a gas onto the windings to cause the hardening of that isocure resin;

removing any excess amine;

arranging, round the said first layers, at least a second layer of a granular material previously mulled with a mixture of a phenolic resin with an isocyanate;

and subsequently spraying a gas carrying an amine to harden that second layer.

3. The method according to claim 1, wherein: the gas carrying the amine along is carbon dioxyde and the step of removing of the excess amine is effected by blowing compressed air thereon.

4. The method according to claim 2, wherein: the gas carrying the amine along is carbon dioxyde and the step of removing of the excess amine is effected by blowing compressed air thereon.

* * * * *